US006784767B2

(12) United States Patent
Hiroshima et al.

(10) Patent No.: US 6,784,767 B2
(45) Date of Patent: Aug. 31, 2004

(54) DIELECTRIC FILTER, DIELECTRIC DUPLEXER, AND COMMUNICATION APPARATUS

(75) Inventors: Motoharu Hiroshima, Ishikawa-ken (JP); Jun Toda, Ishikawa-ken (JP); Hideyuki Kato, Ishikawa-ken (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 81 days.

(21) Appl. No.: 10/245,309

(22) Filed: Sep. 18, 2002

(65) Prior Publication Data

US 2003/0052754 A1 Mar. 20, 2003

(30) Foreign Application Priority Data

Sep. 19, 2001 (JP) ..... 2001-285362

(51) Int. Cl.[7] ..... H01P 1/20; H01P 3/06; H01P 7/04

(52) U.S. Cl. ..... 333/206; 333/222

(58) Field of Search ..... 333/26, 134, 202, 333/204, 206, 222

(56) References Cited

U.S. PATENT DOCUMENTS 6,304,158 B1 * 10/2001 Nishijima et al. ..... 333/206
6,433,655 B1 * 8/2002 Hiroshima et al. ..... 333/206
6,504,455 B2 * 1/2003 Toda et al. ..... 333/202

FOREIGN PATENT DOCUMENTS

JP 2001-136003 5/2001

* cited by examiner

*Primary Examiner*—Patrick Wamsley
(74) *Attorney, Agent, or Firm*—Dickstein, Shapiro, Morin & Oshinsky, LLP

(57) ABSTRACT

A dielectric filter includes a dielectric block having inner-conductor-formed holes extending from a first face of the dielectric block to a second face opposed to the first face. Inner conductors are formed inside the inner-conductor-formed holes such that both ends of the inner-conductor-formed holes are open-circuited. On the exterior surface of the dielectric block, balanced input/output terminals are capacitively coupled to the open ends of the inner-conductor-formed holes. A metal cover is provided so as to cover one of the first or second face of the dielectric block. The metal cover functions as a short-circuit conductor in a spurious mode such as a TE mode other than a TEM mode, and hence the influence of the spurious mode is avoided.

16 Claims, 9 Drawing Sheets

DIELECTRIC FILTER, DIELECTRIC DUPLEXER, AND COMMUNICATION APPARATUS

BACKGROUND OF THE INVENTION

1. Field of the Invention

The present invention relates to dielectric filters for use in the microwave band, to dielectric duplexers, and to communication apparatuses including the same.

2. Description of the Related Art

As known filters for use in the microwave band, dielectric filters formed by a single-stage or multi-stage resonators including a dielectric block containing therein inner-conductor-formed holes and an outer conductor formed on the exterior surface of the dielectric block have been used.

The dielectric filter using the dielectric block includes, on the exterior surface of the dielectric block, input/output terminals which are capacitively coupled to inner conductors, and hence signals are input and output in an unbalanced manner. In order to supply a signal to a balanced-input amplifier circuit, a balun (unbalanced-to-balanced transformer) is used to transform an unbalanced signal into a balanced signal. With this arrangement, the balun has a high insertion loss. It is necessary to have enough space for disposing the balun on a circuit board, and hence the dielectric filter cannot be miniaturized.

The assignee of the present invention has submitted Japanese Patent Application No. 11-314657 and Japanese Patent Application No. 2000-036302 relating to a dielectric filter which is a balanced filter for inputting and outputting signals.

In a dielectric filter which is a balanced filter for inputting and outputting signals, the ideal phase difference between balanced input/output terminals is 180 degrees, and the ideal amplitude difference is zero.

In the dielectric filter with the balanced input/output terminals, filter characteristics differing from those obtained by resonance in a TEM mode by the dielectric block and the inner and outer conductors included therein may be generated. When filter characteristics differing from those expected from the design are generated, the ideal relationship, that is the phase difference between the balanced input/output terminals being 180 degrees and the amplitude difference being zero, cannot be achieved over a wide frequency band.

It can be estimated from various experimental results obtained by the inventors of the present invention that a spurious mode, such as a TE mode, occurs due to the dielectric block and the outer conductor on the exterior surface of the dielectric block. The resonant frequency in the spurious mode influences the operating frequency band, and it can be considered that this influence causes deterioration of balance characteristics.

SUMMARY OF THE INVENTION

Accordingly, it is an object of the present invention to provide a dielectric filter for maintaining balance characteristics over a wide frequency band, a dielectric duplexer, and a communication apparatus including the same.

In accordance with an aspect of the present invention, a dielectric filter is provided including a dielectric block including a plurality of inner-conductor-formed holes extending from a first face of the dielectric block to a second face opposed to the first face; inner conductors formed inside the inner-conductor-formed holes, portions in the vicinity of both ends of the inner conductors being open; balanced input/output terminals formed on the exterior surface of the dielectric block, the balanced input/output terminals being capacitively coupled to portions in the vicinity of open ends of the inner conductor in a predetermined inner-conductor-formed hole of the plurality of inner-conductor-formed holes; an unbalanced input/output terminal formed on the exterior surface of the dielectric block, the unbalanced input/output terminal being capacitively coupled to a portion in the vicinity of one open end of the inner conductor in one of the other inner-conductor-formed holes; an outer conductor formed on the exterior surface of the dielectric block; and a ground electrode connected to the outer conductor, the ground electrode being formed on one aperture face of the dielectric block, the aperture face having apertures of the inner-conductor-formed holes and the unbalanced input/output terminal, or the ground electrode being formed at a predetermined distance from the aperture face. Thus, the dielectric filter can have balanced input/output without being influenced by a spurious mode, such as a TE mode.

In accordance with another aspect of the present invention, a dielectric filter is provided including a dielectric block including a plurality of inner-conductor-formed holes extending from a first face of the dielectric block to a second face opposed to the first face; inner conductors formed inside the inner-conductor-formed holes, portions in the vicinity of both ends of the inner conductors being open; first balanced input/output terminals formed on the exterior surface of the dielectric block, the first balanced input/output terminals being capacitively coupled to portions in the vicinity of open ends of the inner conductor in a predetermined inner-conductor-formed hole of the plurality of inner-conductor-formed holes; second balanced input/output terminals formed on the exterior surface of the dielectric block, the second balanced input/output terminals being capacitively coupled to portions in the vicinity of open ends of the inner conductor in one of the other inner-conductor-formed holes; an outer conductor formed on the exterior surface of the dielectric block; and a ground electrode connected to the outer conductor, the ground electrode being formed on one aperture face of the dielectric block, the aperture face having apertures of the inner-conductor-formed holes, or the ground electrode being formed at a predetermined distance from the aperture face. Thus, the dielectric filter can have balanced input/output without being influenced by a spurious mode, such as a TE mode.

With this arrangement, one of the aperture faces having the apertures of the inner-conductor-formed holes can function as a short-circuit conductor in a resonant mode such as a TE mode due to the dielectric block and the outer conductor. Thus, the resonant frequency in a spurious mode such as a TE mode can be widely shifted, and the influence of the spurious mode can be avoided.

The ground electrode may include a metal cover for covering a portion in the vicinity of the aperture face having the apertures of the inner-conductor-formed holes.

Thus, the influence by a spurious mode, such as a TE mode, can be easily avoided without changing the dielectric block.

The ground electrode may include an electrode film formed on a protrusion protruding from the aperture face of the dielectric block, the aperture face having the apertures of the inner-conductor-formed holes, or formed in a recess bored in the aperture face. Thus, the influence of a spurious mode, such as a TE mode, can be easily avoided without externally providing a metal cover.

The ground electrode may include an electrode film formed on one aperture face of the dielectric block, the aperture face having the apertures of the inner-conductor-formed holes. Thus, the influence of a spurious mode, such as a TE mode, can be easily avoided without externally providing a metal cover.

In accordance with another aspect of the present invention, a dielectric duplexer is provided including a dielectric filter with any one of the foregoing structures. Thus, for example, attenuation in an adjacent frequency band between a transmission filter and a reception filter can be increased. For example, balanced input/output can be performed while a transmission signal is reliably prevented from entering the reception filter.

In accordance with yet another aspect of the present invention, a communication apparatus including the foregoing dielectric filter or the foregoing dielectric duplexer is provided. Thus, a small communication apparatus with highly efficient communication characteristics can be provided without using a balanced-unbalanced transformer.

DESCRIPTION OF THE PREFERRED EMBODIMENTS

The structure of a dielectric filter according to a first embodiment of the present invention will now be described with reference to FIGS. 1 to 4.

Figure 1:
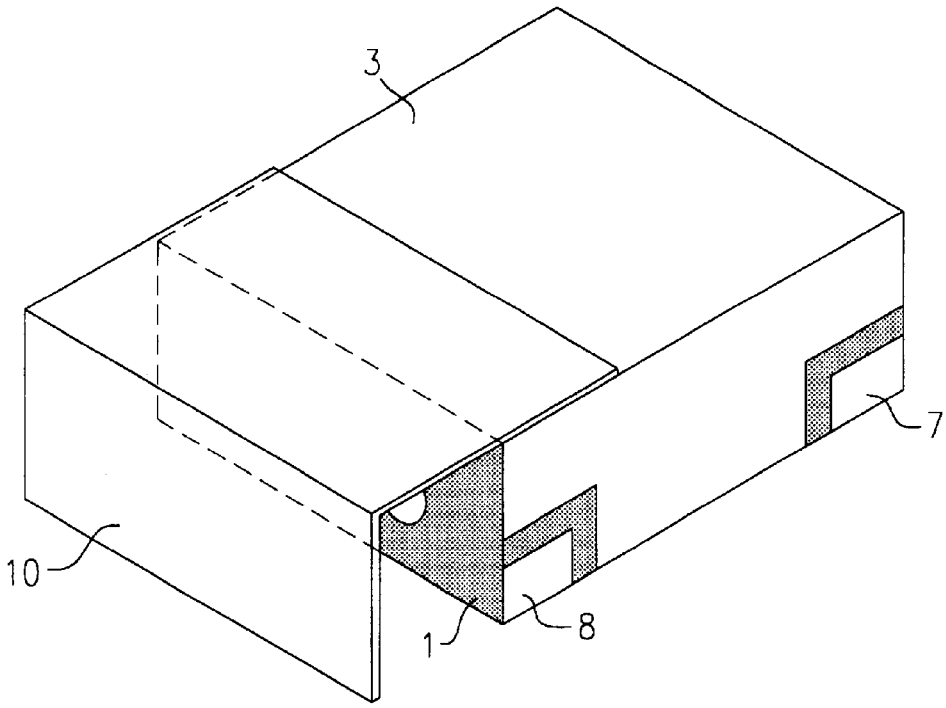
FIG. 1 is a perspective view of a dielectric filter according to a first embodiment of the present invention.

FIG. 1 is a perspective view of a dielectric filter. The dielectric filter includes a dielectric block 1 (preferably a substantially rectangular parallelepiped) having inner-conductor-formed holes therein. On the exterior surface of the dielectric block 1, an outer conductor 3 and input/output terminals 7 and 8 are formed. The outer conductor 3 is not formed on the faces of the dielectric block having the apertures of the inner-conductor-formed holes. A metal cover 10 is provided at a predetermined distance from one of the apertured faces so as to cover the open ends of the inner-conductor-formed holes. The metal cover 10 is partially fixed to the outer conductor 3 with solder or an electro-conductive adhesive. When mounting the dielectric filter with the metal cover 10 on a mounting board, the input/output terminals 7 and 8 are connected to electrodes on the mounting board, and an end of the metal cover 10 is connected with solder to a ground electrode on the mounting board. With this arrangement, the face of the dielectric block having the apertures of the inner-conductor-formed holes is substantially covered with the metal cover 10. As a result, the resonant frequency in a spurious mode, such as a TE mode, which is generated by the dielectric block 1 and the outer conductor 3, can be shifted to a position far from the resonant frequency in a TEM mode to be used.

Figure 2A:
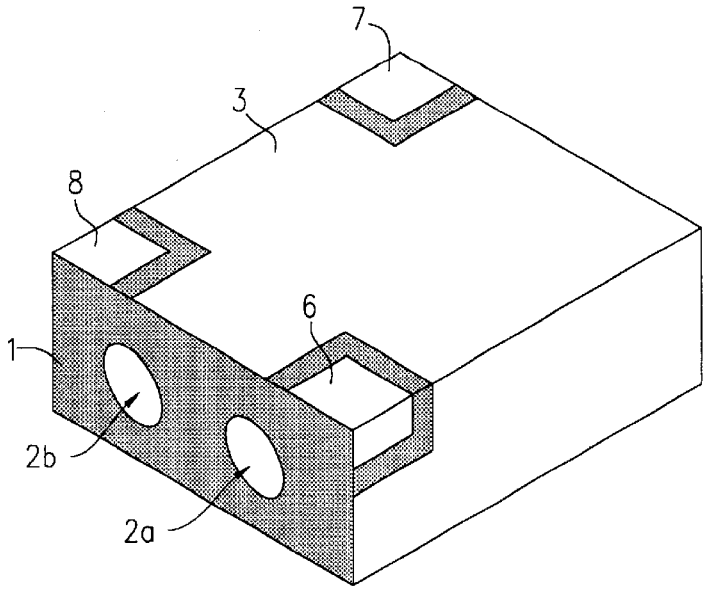
FIG. 2A is a perspective view of the structure of a dielectric block portion of the dielectric filter.
Figure 2B:
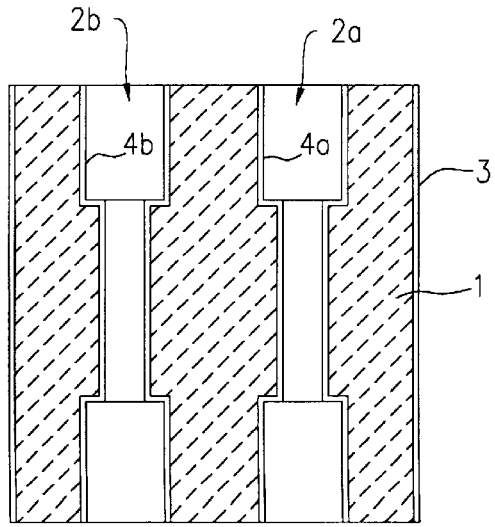
FIG. 2B is a sectional view of the same.

FIG. 2A is a perspective view of the structure of the dielectric filter before the metal cover 10 shown in FIG. 1 is mounted, and FIG. 2B is a sectional view of the same. Specifically, FIG. 2A is a perspective view showing the face to be mounted on the mounting board as the top face, and FIG. 2B is a sectional view taken along the axis of two inner-conductor-formed holes. The dielectric block 1 contains therein two inner-conductor-formed holes 2*a* and 2*b*. The outer conductor 3 is not formed on the faces having the apertures of both ends of the inner-conductor-formed holes 2*a* and 2*b*. Inner conductors 4*a* and 4*b* are formed inside the inner-conductor-formed holes 2*a* and 2*b*, respectively.

With this arrangement, the inner conductors 4*a* and 4*b* each function as a $\lambda/2$ resonator, which is a half-wave resonator with both ends open. The input/output terminal 6 is capacitively coupled to a portion in the vicinity of one open end of the inner conductor 4*a* formed inside the inner-conductor-formed hole 2*a* and functions as an unbalanced input/output terminal. The input/output terminals 7 and 8 are capacitively coupled to portions in the vicinity of both open ends of the inner conductor 4*b* formed inside the inner-conductor-formed hole 2*b* and function as balanced input/output terminals.

One input/output terminal 8 of the balanced input/output terminals and the unbalanced input/output terminal 6 are near the apertured face (the left front side in FIG. 3A), and this apertured face is covered with the metal cover 10 shown in FIG. 1. As a result, the balance characteristics can be improved.

The inner-conductor-formed holes 2*a* and 2*b* have stepped structures in which the internal diameter of portions near the open ends is greater than the internal diameter of central portions in the vicinity of equivalent short-circuit ends. As a result, the adjacent resonators are capacitively coupled to each other, and the axial length of the inner-conductor-formed holes 2*a* and 2*b* is reduced.

Figure 3A:
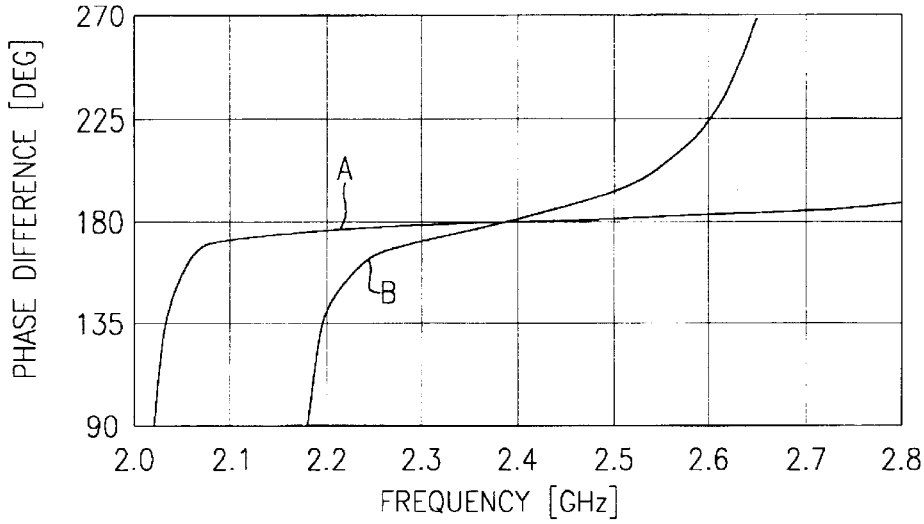
FIGS. 3A and 3B are graphs showing characteristics of the dielectric filter.
Figure 3B:
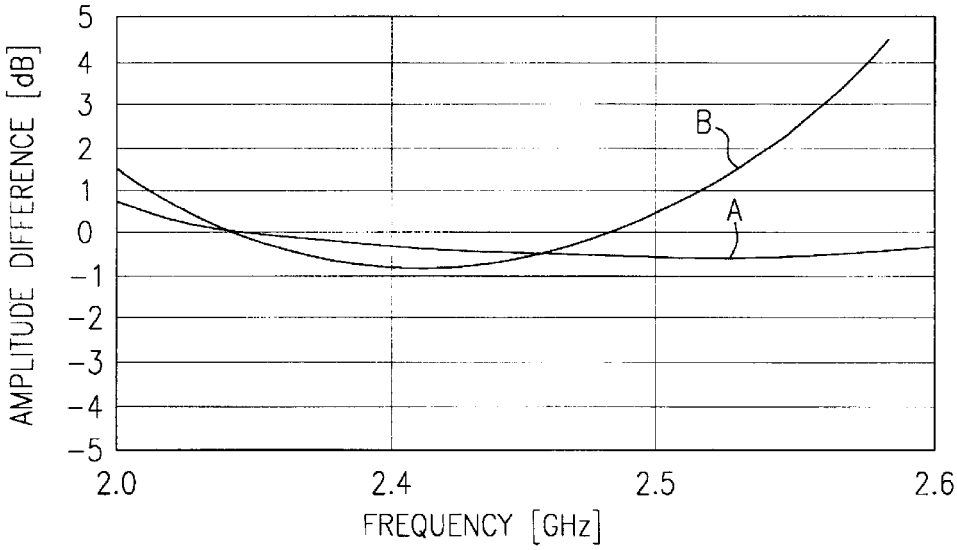

FIGS. 3A and 3B are graphs showing balance characteristics when the dielectric filter arranged as shown in FIG. 1 is designed to have a pass band of 2.4 to 2.5 GHz. Specifically, FIG. 3A shows the phase difference between the balanced input/output terminals 7 and 8, and FIG. 3B shows the amplitude difference between the balanced input/output terminals 7 and 8. Both FIGS. 3A and 3B show characteristics of the dielectric filter with the metal cover 10 and characteristics of the dielectric filter without the metal cover 10. The bold line indicated by symbol A shows the characteristics when the metal cover 10 is provided, and the thin line indicated by symbol B shows the characteristics when no metal cover is provided. By providing the metal cover 10, the phase difference becomes flat in the vicinity of 180 degrees over a wide frequency band greater than or equal to 2.1 to 2.8 GHz, and the amplitude difference is within a range of 11 dB over a wide frequency band. In contrast, when no metal cover is provided, the frequency range over which the phase difference is in the vicinity of 180 degrees is very narrow, and the frequency range over which the amplitude difference is substantially the same is very narrow.

Even when the apertured face having the apertures of the inner-conductor-formed holes 2*a* and 2*b* in the dielectric block 1 (the apertured face at the right back side in FIG. 2A), to which only one input/output terminal 7 of the balanced input/output terminals 7 and 8 is near, is covered with a metal cover, that is, even when the apertured face on the other side is covered with the metal cover 10 shown in FIG. 1, the improvement to the characteristics shown in FIG. 3 is not achieved. It can be concluded from these points that the apertured face close to the two input/output terminals has a great influence on a spurious mode such as a TE mode, and that the resonant frequency in a spurious mode such as a TE mode can be widely separated by covering the apertured face with a short-circuit conductor.

Figure 4:
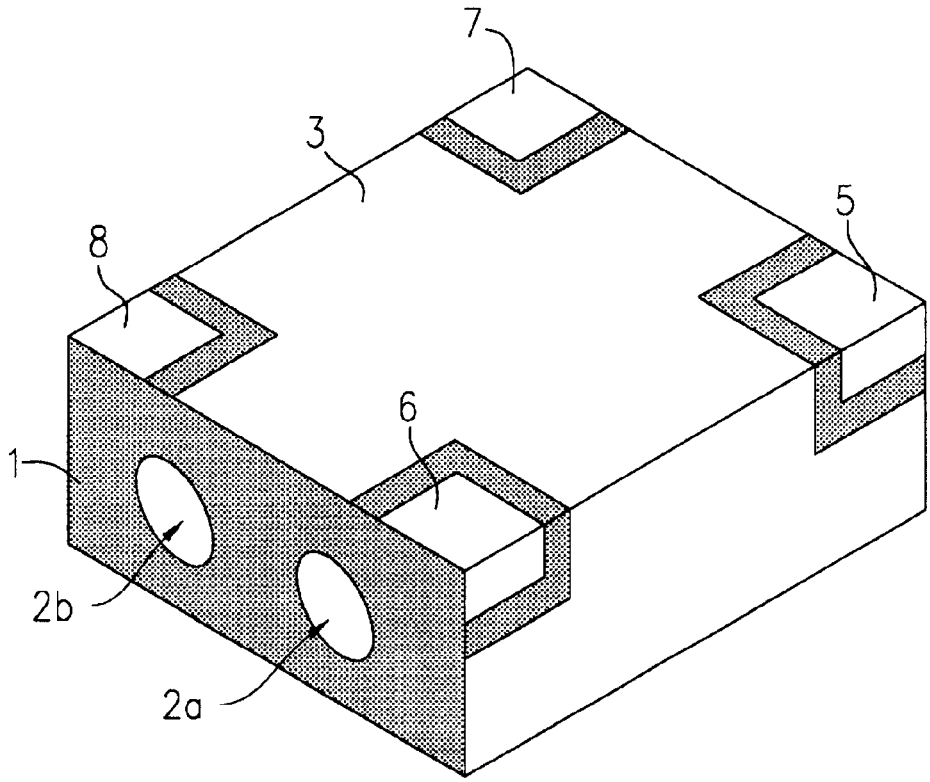
FIG. 4 is a perspective view of another example of the structure of the dielectric block portion.

In the example shown in FIGS. 2A and 2B, the dielectric filter with a balanced-unbalanced transforming function is illustrated. However, the outer conductor 3 and the input/output terminals 5, 6, 7, and 8 formed on the exterior surface of the dielectric block 1 can be arranged as shown in FIG. 4. In this case, a balanced input-output dielectric filter having two balanced ports can be provided. More specifically, referring to FIG. 4, the first balanced input/output terminals 5 and 6 are capacitively coupled to portions in the vicinity of respective open ends of the inner conductor formed inside the inner-conductor-formed hole 2*a*. Similarly, the second balanced input/output terminals 7 and 8 are capacitively coupled to portions in the vicinity of respective open ends of the inner conductor formed inside the inner-conductor-formed hole 2*b*. The remaining structure is similar to that shown in FIGS. 2A and 2B.

Figure 5A:
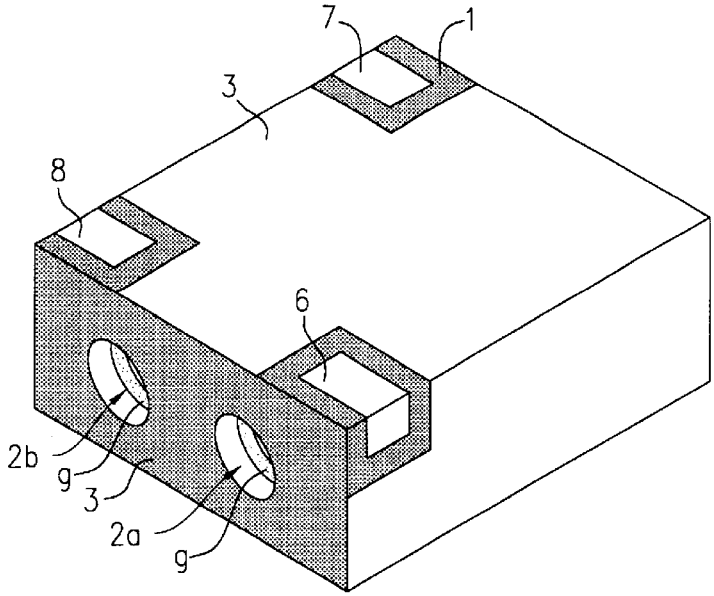
FIG. 5A is a perspective view of a dielectric filter according to a second embodiment of the present invention.
Figure 5B:
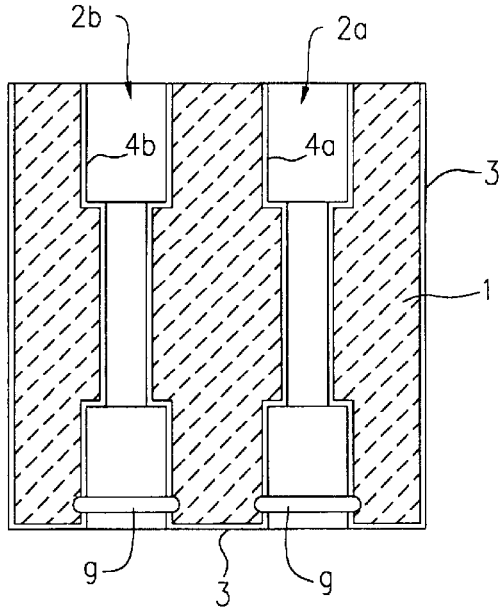
FIG. 5B is a sectional view of the same.

FIG. 5A is a perspective view of a dielectric filter according to a second embodiment of the present invention, and FIG. 5B is a sectional view of the same. Specifically, FIG. 5A shows the face to be mounted on the mounting board as the top face, and FIG. 2B is a sectional view taken along the axis of two inner-conductor-formed holes 2*a* and 2*b*. Unlike the dielectric filter shown in FIGS. 2A and 2B, the outer conductor 3 is formed on one of the apertured faces of the dielectric block having the apertures of the inner-conductor-formed holes 2*a* and 2*b*. Also, inner-conductorless portions g are provided in the vicinity of the apertured face on which the outer conductor 3 is formed. The inner conductors 4*a* and 4*b* are open due to the inner-conductorless portions g. The remaining structure is similar to that shown in FIGS. 2A and 2B.

By forming the outer conductor 3 on one apertured face having the apertures of the inner-conductor-formed holes 2*a* and 2*b*, the resonant frequency in a spurious mode such as a TE mode, due to the dielectric block 1 and the outer conductor 3, is widely separated from the operating frequency band. As a result, wide frequency band characteristics similar to those shown in FIGS. 3A and 3B can be achieved.

Figure 6:
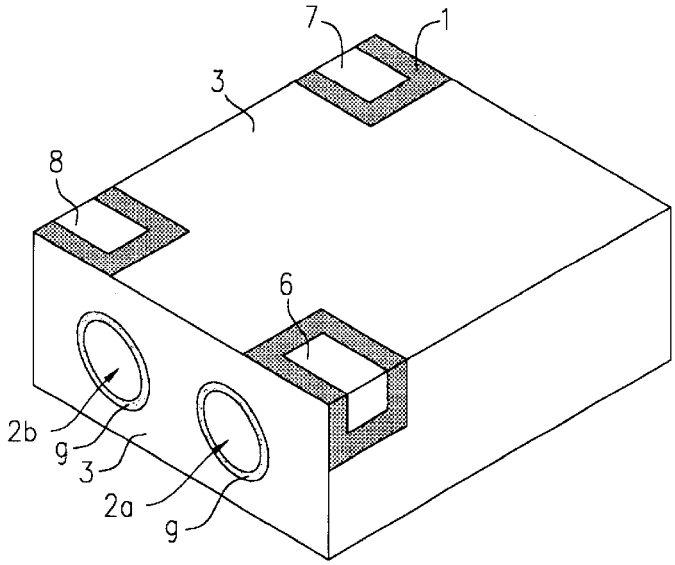
FIG. 6 is a perspective view of a dielectric filter according to a third embodiment of the present invention.

FIG. 6 is a perspective view of a dielectric filter according to a third embodiment of the present invention. In this example, the outer conductor 3 is formed on one apertured face of the dielectric block (the left front side in FIG. 6) having the apertures of the inner-conductor-formed holes 2*a* and 2*b*. Gaps g are provided so that the outer conductor 3 is not connected to the inner conductors formed inside the inner-conductor-formed holes 2*a* and 2*b*. The remaining structure is similar to that in FIGS. 2A and 2B.

With this arrangement, a dielectric filter with two resonators exhibiting a half-wave resonance, which is capable of suppressing the influence of a spurious mode such as a TE mode due to the dielectric block 1 and the outer conductor 3, can be obtained.

Figure 7:
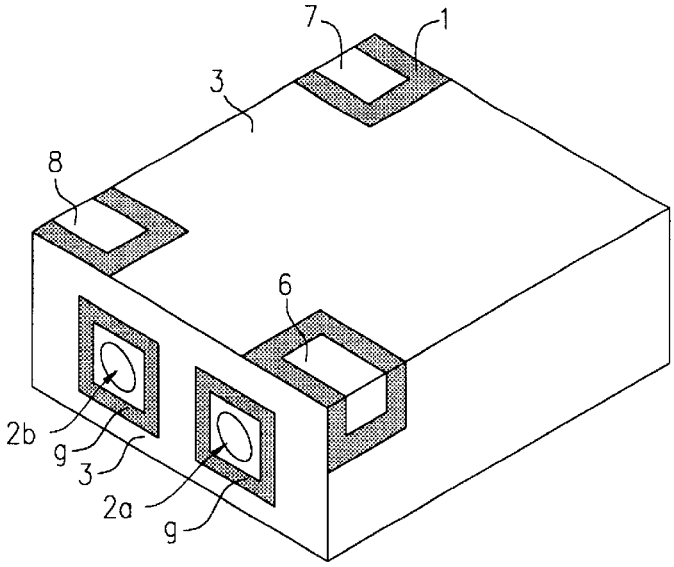
FIG. 7 is a perspective view of a dielectric filter according to a fourth embodiment of the present invention.

FIG. 7 is a perspective view of a dielectric filter according to a fourth embodiment of the present invention. In this example, electrodes 11*a* and 11*b* for connecting to the inner conductors and the outer conductor 3 are formed on one apertured face of the dielectric block having the apertures of the inner-conductor-formed holes 2*a* and 2*b*. The remaining structure is similar to that shown in FIGS. 2A and 2B.

Similar advantages can be achieved by this structure, although this structure generates stray capacitance between one open end of each inner conductor and the outer conductor formed on the aperture face.

Figure 8:
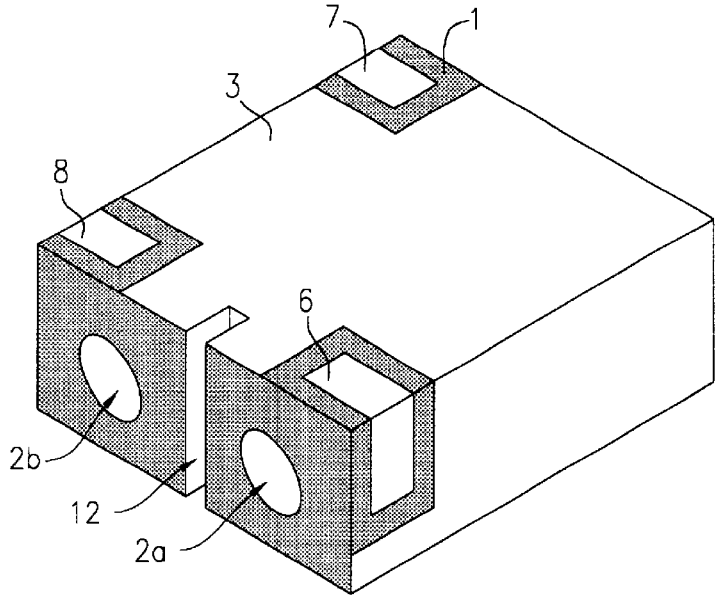
FIG. 8 is a perspective view of a dielectric filter according to a fifth aspect of the present invention.

FIG. 8 is a perspective view of a dielectric filter according to a fifth embodiment of the present invention. In this example, a slit recess 12 with a predetermined depth is formed in one apertured face of the dielectric block 1 having the apertures of the inner-conductor-formed holes 2*a* and 2*b*, and the outer conductor 3 is formed inside the recess 12. The remaining structure is similar to that shown in FIGS. 2A and 2B. The conductor 3 formed in the recess 12 functions as a short-circuit conductor in a spurious mode such as a TE mode due to the dielectric block 1 and the outer conductor 3, and hence the frequency in the spurious mode can be shifted to a frequency having no influence on the operating frequency band.

Since the outer conductor 3 formed in the recess 12 is located between the open ends of the inner conductors formed inside the two inner-conductor-formed holes 2*a* and 2*b*, the degree of coupling between the two resonators can be determined at the same time by the recess 12. In other words, the outer conductor 3 formed in the recess 12 suppresses the capacitive coupling between the two resonators and relatively increases the inductive coupling. As a result, the degree of coupling between the two resonators can be determined.

Figure 9:
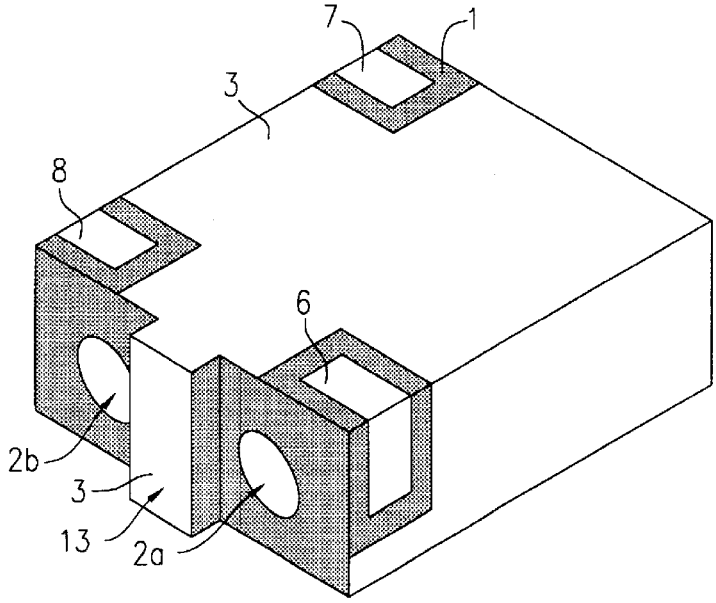
FIG. 9 is a perspective view of a dielectric filter according to a sixth embodiment of the present invention.

FIG. 9 is a perspective view of a dielectric filter according to a sixth embodiment of the present invention. In this example, a protrusion 13 extending from the apertured face having the apertures of the inner-conductor-formed holes 2*a* and 2*b*, and the outer conductor 3 is formed on the surface of the protrusion 13. The remaining structure is similar to that shown in FIGS. 2A and 2B.

By providing the outer conductor 3 in the vicinity of one apertured face having the apertures of the inner-conductor-formed holes 2*a* and 2*b*, the outer conductor 3 functions as a short-circuit conductor in a spurious mode, and hence the influence of the spurious mode can be avoided. In this example, the position of the outer conductor 3 protrudes from one apertured face having the apertures of the inner-conductor-formed holes 2*a* and 2*b*. Unlike the structure shown in FIG. 8, the influence of the spurious mode can be avoided without influencing the degree of coupling between the two resonators.

Figure 10:
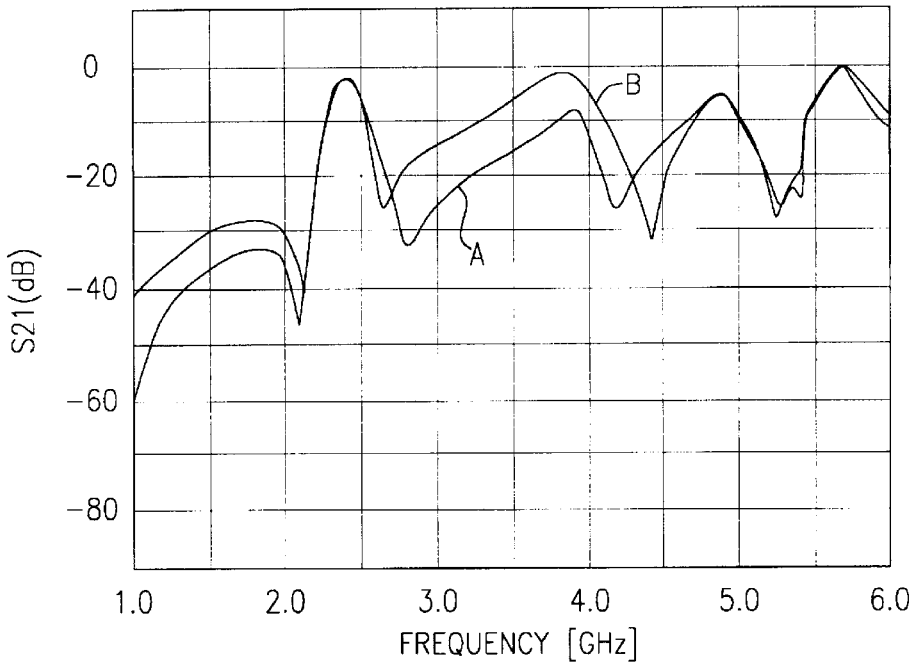
FIG. 10 is a graph showing characteristics of the dielectric filter shown in FIG. 9 and characteristics of a known dielectric filter.

FIG. 10 is a graph showing characteristics of the dielectric filter shown in FIG. 9 and characteristics of a known dielectric filter. Symbol A denotes transmission characteristics of the dielectric filter shown in FIG. 9, and symbol B denotes transmission characteristics of the known dielectric filter. The known dielectric filter has a band-pass characteristic centered at 2.4 GHz. By providing the protrusion 13 shown in FIG. 9 and the outer conductor 3 formed on the protrusion 13, the resonant frequency in a spurious mode such as a TE mode can be widely separated from the operating frequency band, and hence the influence of the spurious mode can be suppressed. Thus, large attenuation can be provided in a high pass band and a low pass band.

Figure 11:
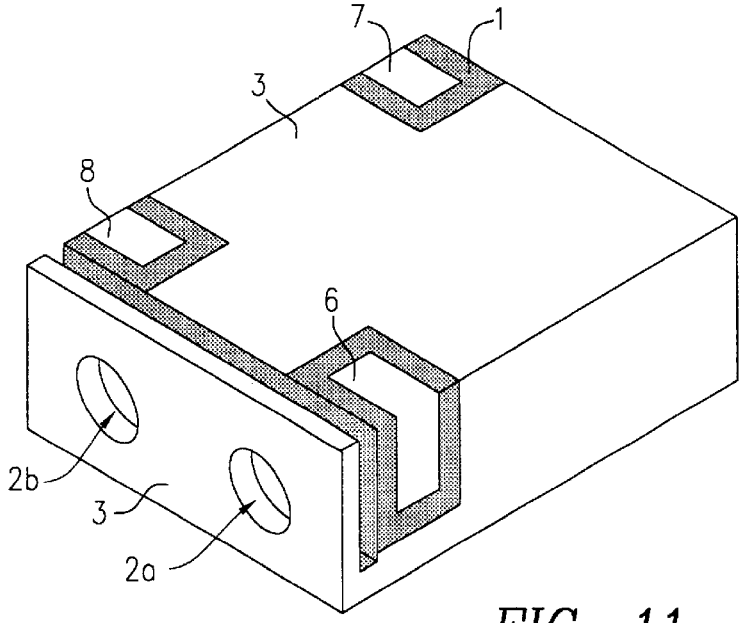
FIG. 11 is a perspective view of a dielectric filter according to a seventh aspect of the present invention.

FIG. 11 is a perspective view of a dielectric filter according to a seventh embodiment of the present invention. In this example, a slit 14 is formed in the dielectric block 1 so as to divide the inner-conductor-formed holes 2*a* and 2*b* at an end thereof. The inner conductors formed inside the inner-conductor-formed holes 2*a* and 2*b* are open at the slit 14. The outer conductor 3 is not formed on the opposed faces of the dielectric block defined by the slit 14. The outer conductor 3 is formed on the outer surface partitioned by the slit 14. Since this outer conductor 3 is not connected to the inner conductors, the outer surface is not a short-circuit face in a TEM mode. Rather, the outer surface (outer conductor 3) functions as a short-circuit conductor in a spurious mode such as a TE mode. With this arrangement, the resonant frequency in the spurious mode can be widely separated from the operating frequency band.

Although a dielectric filter including resonators of two stages formed on the dielectric block has been described in the foregoing embodiments, a dielectric filter can have resonators of three or more stages may be used in a similar manner.

Although a case in which a pair of dielectric filters is formed on the dielectric block has been described in the foregoing embodiments, two pairs of filters to be used as a transmission filter and a reception filter can be formed on a single dielectric block in a similar manner, and a dielectric duplexer as an antenna duplexer can be provided.

Figure 12:
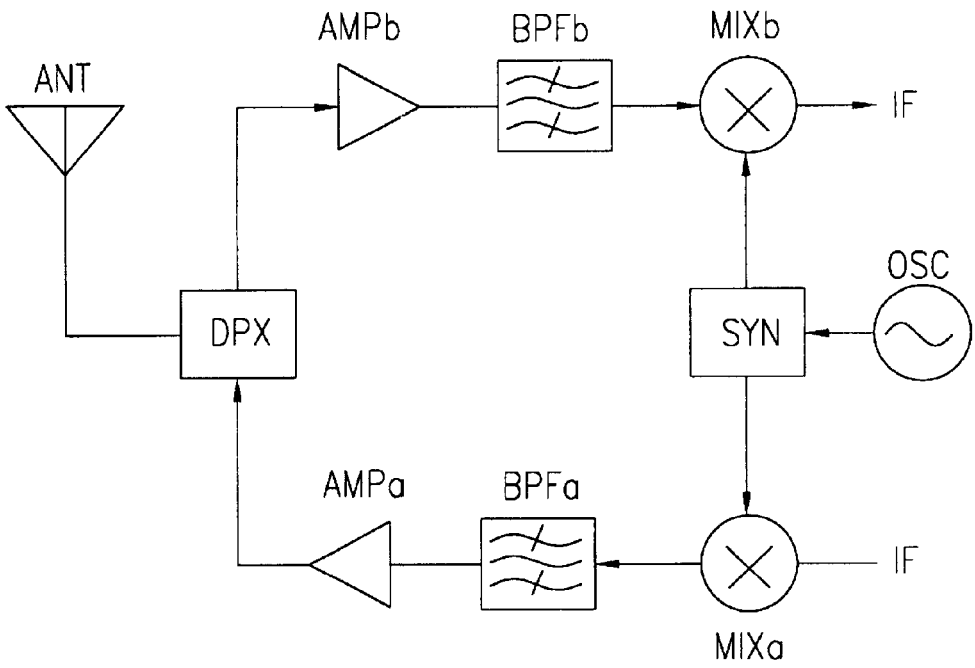
FIG. 12 is a block diagram of the structure of a communication apparatus according to an eighth embodiment of the present invention.

Referring to FIG. 12, the structure of a communication apparatus according to an eighth embodiment of the present invention will now be described.

Referring to FIG. 12, the communication apparatus includes a transmitting/receiving antenna ANT, a duplexer DPX, band-pass filters BPFa and BPFb, amplifier circuits AMPa and AMPb, mixers MIXa and MIXb, an oscillator OSC, and a frequency synthesizer SYN.

The mixer MIXa mixes a transmission intermediate frequency signal IF and a signal output from the frequency synthesizer SYN. The band-pass filter BPFa passes a transmission frequency band of the mixed output signal from the mixer MIXa. The amplifier AMPa performs power amplification of the resultant signal. The amplified signal is transmitted through the duplexer DPX from the transmitting/receiving antenna ANT. The amplifier AMPb amplifies a reception signal taken from the duplexer DPX. The band-pass filter BPFb passes a reception frequency band of the reception signal output from the amplifier AMPb. The mixer MIXb mixes a frequency signal output from the frequency synthesizer SYN and the reception signal and outputs a reception intermediate frequency signal IF.

What is claimed is:

1. A dielectric filter comprising:

a dielectric block including a plurality of holes extending from a first face of the dielectric block to a second face of the dielectric block, the second face being opposed to the first face;

a respective inner conductor formed on an inner surface of each of the plurality of holes in the dielectric block such that the open ends of the plurality of holes are open-circuited;

balanced input/output terminals formed on an exterior surface of the dielectric block, the balanced input/output terminals being capacitively coupled to respective open ends of a first hole of the plurality of holes;

an unbalanced input/output terminal formed on the exterior surface of the dielectric block, the unbalanced input/output terminal being capacitively coupled to the open end of a second hole of the plurality of holes;

an outer conductor formed on the exterior surface of the dielectric block; and a ground electrode connected to the outer conductor, the ground electrode being formed at one of the first face and second face of the dielectric block.

2. The dielectric filter according to claim 1, wherein the ground electrode is formed at a predetermined distance from the one of the first face and the second face of the dielectric block.

3. The dielectric filter according to claim 2, wherein the ground electrode comprises a metal cover that covers the one of the first face and the second face of the dielectric block.

4. The dielectric filter according to claim 1, wherein the ground electrode is formed on one of the first face and second face of the dielectric block.

5. The dielectric filter according to claim 4, wherein the ground electrode comprises an electrode film formed on a protrusion extending from the one of the first face and the second face of the dielectric block.

6. The dielectric filter according to claim 4, wherein the ground electrode comprises an electrode film formed in a recess bored in the one of the first face and the second face of the dielectric block.

7. A dielectric duplexer comprising a dielectric filter as set forth in claim 1.

8. A communication apparatus comprising a dielectric filter as set forth in claim 1.

9. A dielectric filter comprising:

a dielectric block including a plurality of holes extending from a first face of the dielectric block to a second face of the dielectric block, the second face being opposed to the first face;

a respective inner conductor formed on an inner surface of each of the plurality of holes in the dielectric block such that the open ends of the plurality of holes are open-circuited;

first balanced input/output terminals formed on an exterior surface of the dielectric block, the first balanced input/output terminals being capacitively coupled to respective open ends of a first hole of the plurality of holes;

second balanced input/output terminals formed on the exterior surface of the dielectric block, the second balanced input/output terminals being capacitively coupled to respective open ends of a second hole of the plurality of holes;

an outer conductor formed on the exterior surface of the dielectric block; and a ground electrode connected to the outer conductor, the ground electrode being formed at one of the first face and second face of the dielectric block.

10. The dielectric filter according to claim 9, wherein the ground electrode is formed at a predetermined distance from the one of the first face and the second face of the dielectric block.

11. The dielectric filter according to claim 10, wherein the ground electrode comprises a metal cover that covers the one of the first face and the second face of the dielectric block.

12. The dielectric filter according to claim 9, wherein the ground electrode is formed on one of the first face and second face of the dielectric block.

13. The dielectric filter according to claim 12, wherein the ground electrode comprises an electrode film formed on a protrusion extending from the one of the first face and the second face of the dielectric block.

14. The dielectric filter according to claim 12, wherein the ground electrode comprises an electrode film formed in a recess bored in the one of the first face and the second face of the dielectric block.

15. A dielectric duplexer comprising a dielectric filter as set forth in claim 9.

16. A communication apparatus comprising a dielectric filter as set forth in claim 9.

* * * * *

UNITED STATES PATENT AND TRADEMARK OFFICE

CERTIFICATE OF CORRECTION

PATENT NO. : 6,784,767 B2
DATED : August 31, 2004
INVENTOR(S) : Motoharu Hiroshima et al.

It is certified that error appears in the above-identified patent and that said Letters Patent is hereby corrected as shown below:

Title page,
Item [56], References Cited, FOREIGN PATENT DOCUMENTS, please add:
-- JP 4-139901 (w/English abstract), 05/13/1992 --

Signed and Sealed this

Twenty-second Day of March, 2005

JON W. DUDAS
*Director of the United States Patent and Trademark Office*